US005631679A

United States Patent [19]

Kagayama

[11] Patent Number: 5,631,679

[45] Date of Patent: May 20, 1997

[54] IMAGE FORMING APPARATUS HAVING APERTURE ELECTRODE UNIT INCLUDING INSULATING MEMBER WITH HIGH DIELECTRIC CONSTANT

[75] Inventor: Shigeru Kagayama, Owariasahi, Japan

[73] Assignee: Brother Kogyo Kabushiki Kaisha, Nagoya, Japan

[21] Appl. No.: 262,441

[22] Filed: Jun. 20, 1994

[30] Foreign Application Priority Data

Jul. 28, 1993 [JP] Japan ..... 5-186112

[51] Int. Cl.[6] ..... B41J 2/385

[52] U.S. Cl. ..... 347/55; 347/158; 399/291

[58] Field of Search ..... 347/158, 55; 355/246, 355/247, 248

[56] References Cited

U.S. PATENT DOCUMENTS 3,689,935 9/1972 Pressman et al. .
3,977,323 8/1976 Pressman et al. ..... 347/55
4,743,926 5/1988 Schmidlin et al. .
4,755,837 7/1988 Schmidlin et al. .
4,777,500 10/1988 Salmon ..... 347/55
4,780,733 10/1988 Schmidlin .
4,814,796 3/1989 Schmidlin .
4,912,489 3/1990 Schmidlin .
5,036,341 7/1991 Larsson .

*Primary Examiner*—Mark J. Reinhart
*Attorney, Agent, or Firm*—Oliff & Berridge

[57] ABSTRACT

An aperture electrode unit of an image forming apparatus includes an insulating sheet, control electrodes formed on the insulating sheet and apertures formed in the aperture electrode unit. The insulating sheet is formed of material having a dielectric constant higher than a toner layer. With this construction, a voltage applied across the control electrodes and the toner carry roller is divided in accordance with a capacity rate of these elements. Thus, the voltage is effectively applicable to the toner layer, so that the toner control performance can be improved even at a low-voltage driving time. Therefore, an excellent image recording operation can be performed by a low-voltage driving operation.

17 Claims, 3 Drawing Sheets

IMAGE FORMING APPARATUS HAVING APERTURE ELECTRODE UNIT INCLUDING INSULATING MEMBER WITH HIGH DIELECTRIC CONSTANT

BACKGROUND OF THE INVENTION

1. Field of the Invention

This invention relates to an image forming apparatus for use in a reproductive device, such as a copying machine, a printer, a plotter, or a facsimile machine.

2. Description of Related Art

Known image forming apparatus in which an image is formed use a toner-flow control means having plural opening portions (hereinafter referred to as "apertures"). In such an image forming apparatus, a voltage according to image data is applied to the toner-flow control means to control toner particles to selectively pass through the apertures. The toner particles that have passed through the apertures of the toner-flow control means are deposited on a supporter (image receiving medium) to form an image. Such an image forming apparatus as described above is disclosed in U.S. Pat. No. 3,689,935, for example.

This image forming apparatus includes an aperture electrode unit serving as the toner-flow control means, and further includes a potential supply means, a toner supply means and a positioning means.

The aperture electrode unit comprises a flat plate formed of insulating material, a reference electrode, plural control electrodes and plural apertures. The reference electrode is continuously formed on one surface of the flat plate, and the control electrodes are formed on the other surface of the flat plate to be electrically insulated from one another. The apertures are formed in a row in correspondence with the respective control electrode to penetrate through the flat plate, the reference electrode and the control electrodes.

The potential supply means serves to selectively apply a potential across the reference electrode and the control electrodes of the aperture electrode unit on the basis of image data. The toner supply means serves to supply charged toner particles to the lower side of the aperture electrode unit so that the flow of the toner particles passing through the apertures is modulated according to the potential applied to the aperture electrode unit. The positioning means serves to feed and position a supporter (on which an image will be formed) in a flow path of the toner particles to be movable relatively to the aperture electrode unit.

Further, in U.S. Pat. No. 4,743,926, U.S. Pat. No. 4,755,837, U.S. Pat. No. 4,780,733, and U.S. Pat. No. 4,814,796, a first type of image forming apparatus is disclosed in which the reference electrode of the aperture electrode unit is disposed to face the toner supply means side and the control electrodes of the aperture electrode unit are disposed to face the supporter side on which an image will be formed.

On the other hand, U.S. Pat. No. 4,912,489 discloses a second type of image forming apparatus in which the control electrodes of the aperture electrode are disposed to face the toner supply means side and the reference electrode of the aperture electrode is disposed to face the supporter side. As described in the U.S. Pat. No. 4,912,489, with this construction, the second type of image forming apparatus can reduce a voltage to be applied to the control electrodes at an off-time to about a quarter of that of the first type of image forming apparatus. The term "off-time" means a time when no toner particle is deposited on the supporter, that is, a time when a blank portion of an image is formed on the supporter. On the other hand, "on-time" means a time when a toner image is formed on the supporter.

However, the first and second types of image forming apparatus have a disadvantage that the toner is liable to pass through the apertures and be attached onto the supporter even at the off-time when no toner image is formed on the supporter. Thus, image quality is unstable.

To overcome the above disadvantage, a method has been proposed of reducing a driving voltage for electric-field control of the toner by making the insulating flat plate of the aperture electrode unit thin. In this method, however, the motion of insufficiently-charged toner supplied by the toner supply means cannot be sufficiently controlled because a voltage for controlling the passage of the toner through the apertures is lowered. That is, the insufficiently-charged toner cannot be controlled by the electric field generated with a low voltage. Accordingly, it is highly possible that the insufficiently-charged toner may pass (jump out) through the apertures provided on the thin flat plate due to only a mechanical force. As a result, like the first and second types of image forming apparatus, there occurs a problem that a small amount of toner passes through the apertures even at the off-time when no toner image is formed and is deposited on the supporter. To suppress the mechanical passing (jump-out) of the toner as described above, the insulating flat plate must be made thick. However, if the flat plate is merely made thick, a dielectric gap would be larger, and the intensity of the electric field due to the control voltage would not be sufficiently increased. So, an image will be formed with low density, and high-speed recording cannot be performed.

SUMMARY OF THE INVENTION

An object of this invention is to provide an image forming apparatus capable of performing a high-density, high-quality and high-speed image recording with a low driving voltage.

To attain the above and other objects, the image forming apparatus according to this invention includes a carrier for carrying thereon and supplying charged particles and electric-field control means for directly controlling the charged particles with an electric field. Further, at least a part of the electric-field control means is formed of high-dielectric material having a dielectric constant that is higher than the charged particles.

According to the image forming apparatus thus constructed, even when the high-dielectric material portion is made thick, the intensity of electric field in a toner layer can be increased. So, an electrode unit having excellent control performance of electric field and sufficient mechanical strength can be obtained. Accordingly, the image quality can be improved, and high-speed recording can be performed.

BRIEF DESCRIPTION OF THE DRAWINGS

Preferred embodiments of the present invention are described in detail with reference to the following figures wherein.

DETAILED DESCRIPTION OF PREFERRED EMBODIMENTS

Preferred embodiments according to this invention are described with reference to the accompanying drawings.

Figure 1:
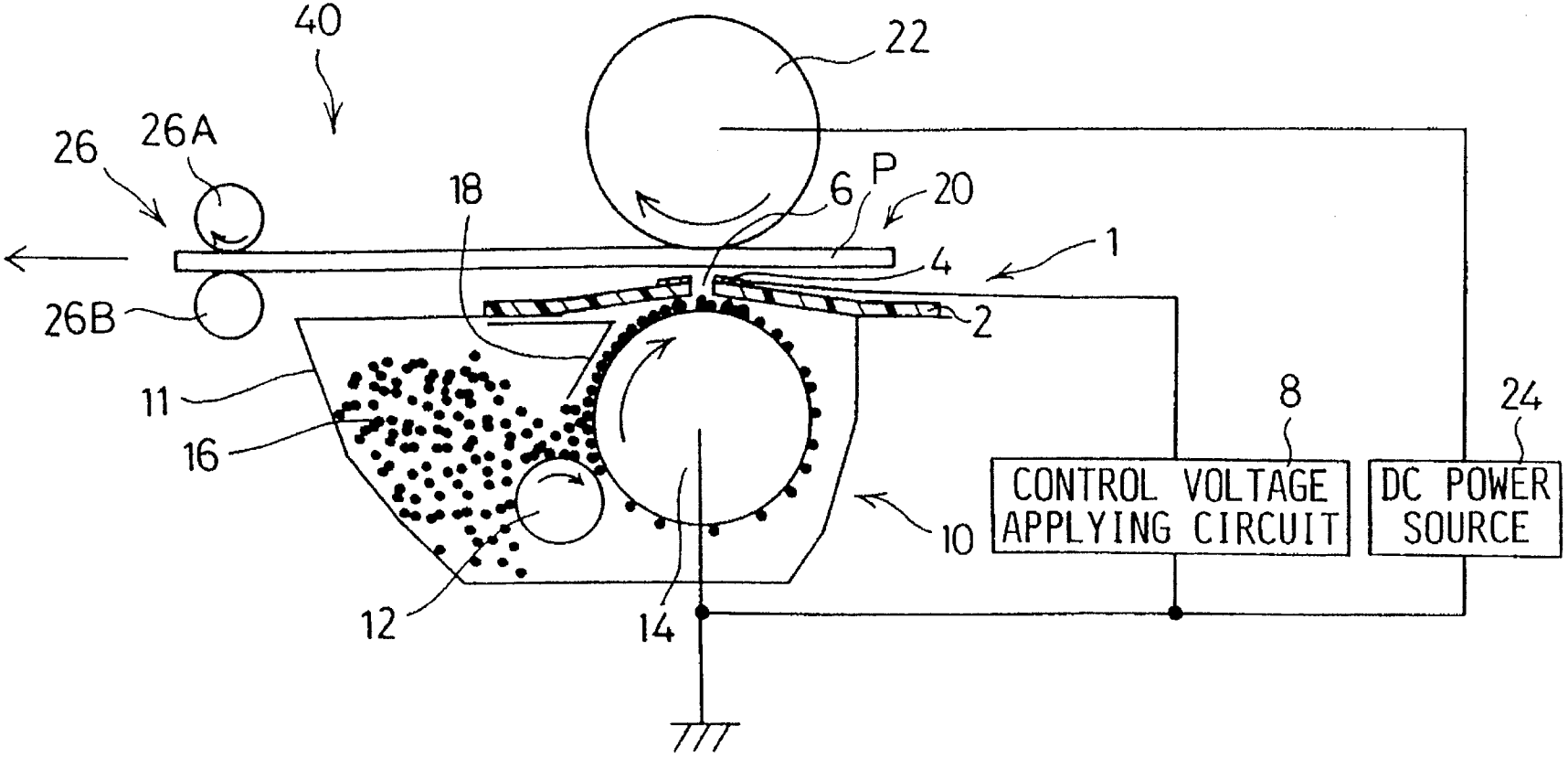
FIG. 1 is a schematic view of a main part of an image forming apparatus having an aperture electrode unit according to this invention.
Figure 2:
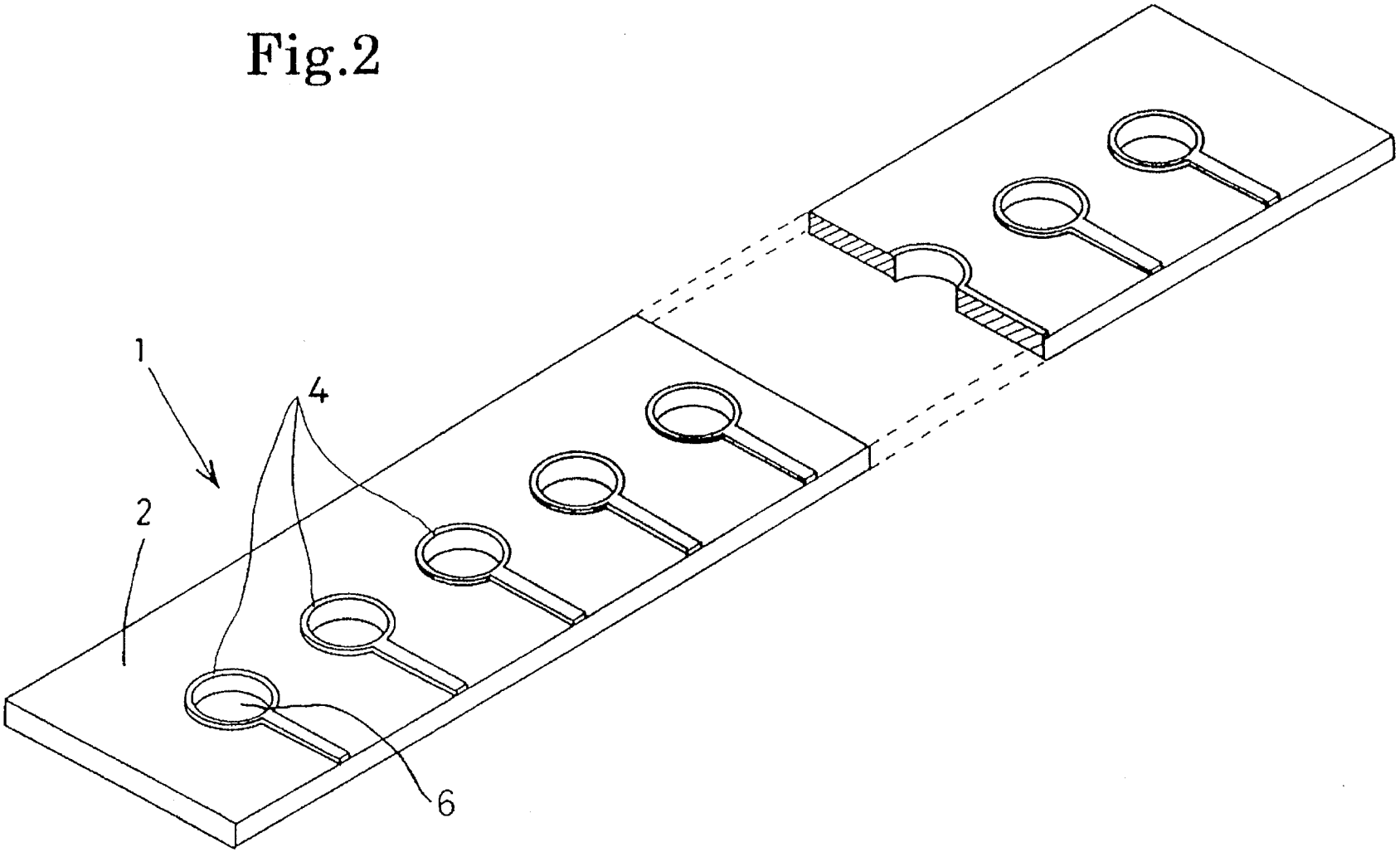
FIG. 2 is a perspective view showing the construction of the aperture electrode unit of an embodiment.

First, the construction of a main part of the image forming apparatus of the preferred embodiment is schematically described with FIGS. 1 and 2. The main part of the image forming apparatus essentially includes a toner supply portion 10, a toner control portion 20 and a supporter feeding portion 40.

The toner supply portion 10 comprises a toner case 11, which also serves as a housing for the whole toner supply portion 10, toner 16 stocked in the toner case 11, a toner supply roller 12, a toner carry roller 14 and a toner-layer restricting blade 18.

The toner supply roller 12 is disposed rotatably in a direction as indicated by an arrow in FIG. 1. The toner supply roller 12 serves to negatively charge the toner 16 through frictional contact with the toner 16 in the toner case 11 and attract the charged toner 16 onto the surface thereof.

The toner carry roller 14 is also disposed rotatably in a direction as indicated by an arrow in FIG. 1 so as to be substantially in contact with and in parallel to the toner supply roller 12. Therefore, the toner carry roller 14 frictionally contacts the charged toner 16, which is being fed while electrostatically attracted onto the surface of the toner supply roller 12, thereby further charging the toner 16 negatively. The toner carry roller 14 carries the further charged toner 16 thereon while attracting the toner 16 onto the surface thereof and feeds the toner 16 toward an aperture electrode unit 1. The toner carry roller 14 is grounded.

The toner-layer restricting blade 18 is disposed to press against the toner carry roller 14. It adjusts the toner layer on the toner carry roller 14 so that the amount of the toner 16 is uniform on the surface of the toner carry roller 14 and also uniformly charges the toner 16. The toner supply portion 10 is disposed along the longitudinal direction of the aperture electrode unit 1 as described later.

The toner control portion 20 comprises the aperture electrode unit 1, a control voltage applying circuit 8, a back electrode roller 22 and a DC power source 24.

As shown in FIG. 2, the aperture electrode unit 1 comprises an insulating sheet 2 of preferably 25 μm thickness, plural apertures 6 of preferably 40 μm diameter arranged in a row and control electrodes 4 of preferably 1 μm thickness each of which is formed on the upper surface of the insulating sheet 2 in correspondence with each aperture 6. As shown in FIG. 1, the aperture electrode unit 1 is pressed against the toner carry roller 14 at the position corresponding to the apertures 6 on the insulating sheet 2 while the control electrodes 4 confront a supporter P (the image receiving medium).

The toner has a dielectric constant ranging from 2 to 3, and the insulating sheet 2 has a dielectric constant that is higher than at least that of the toner. The following materials may be used for the insulating sheet 2: synthetic resins such as phenolic resin, polyethylene terephthalate, polyester resin, alkyd resin, epoxy resin, phenoxy resin, polycarbonate resin, silicone resin, urea resin, melamine resin, nylon, polyimide, polymethyl methacrylate, methyl methacrylate-styrene copolymerization, acrylonitride-butadiene-styrene copolymerization, polyvinyl chloride, polyvinylidene chloride, polyvinylidene fluoride, polyvinyl formal, polyvinyl butyral, polyvinyl carbazole, acetal resin, chlorinated polyether, polysuflone, acetylcellulose, nitrocellulose, celluloid, etc., and oxides such as alumina, beryllia, calcia, magnesia, silicon oxide, thoria, urania, mullite, spinel, forsterite, zirconia, zircon, etc. Particularly, the following materials are preferable for the insulating sheet 2: oxide ferroelectric substances such as barium titanate, lead titanate, lead niobate, potassium niobate, potassium tantalate, etc., organic ferroelectric substances such as polyvinylidene fluoride, vinylidene fluoride-ethylene trifluoride copolymerization, vinylidene cyanide-vinyl acetate copolymerization, etc.

Next, the positional relationship between the apertures 6 of the aperture electrode unit 1 and the toner carry roller 14 is described in detail with reference to FIG. 3.

Each aperture 6 is located at such a position that the center axis 30 thereof passes over the uppermost portion on the peripheral surface of the toner carry roller 14 (in FIG. 3) and the center axis 32 of the toner carry roller 14. With this arrangement, each aperture 6 is disposed symmetrically at right and left sides with respect to the uppermost portion of the peripheral surface of the toner carry roller 14, so that a toner distribution of the toner 16 passing through each aperture 6 can be made uniform over the whole area within the aperture. Further, as the wall surface of the aperture 6 and the flight direction of the toner 16 are in parallel to each other, the toner 16 can take a stable flight.

Figure 3:
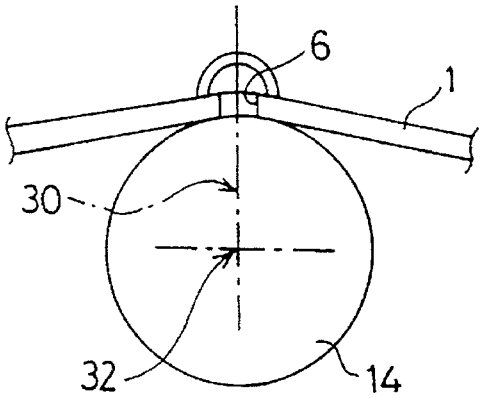
FIG. 3 is a schematic diagram showing an arrangement of the aperture electrode unit according to the embodiment of FIG. 2 and a toner carry roller.

Further, the aperture electrode itself 1 is pressed against the toner carry roller 14 so as to be bent toward the right and left sides by the same angle with the apertures 6 at the center, as shown in FIG. 3. With this construction, the contact area between the aperture electrode 1 and the toner carry roller 14 can be increased, and the lower peripheral portion of the apertures 6 can be uniformly pressed at the right and left sides thereof. So, occurrence of unevenness of toner density can be maximally suppressed.

The control electrodes 4 are connected to the control voltage applying circuit 8. The control voltage applying circuit 8 is designed to apply a voltage of 0V or 50V to the control electrodes 4 on the basis of an image signal.

The back electrode roller 22 is designed in a cylindrical form and disposed to face the toner carry roller 14 through the apertures 6 of the aperture electrode unit 1. The back electrode roller 22 is spaced from the aperture electrode unit 1 at substantially a 1 mm interval and rotatably supported by a chassis (not shown). Accordingly, the supporter P will be inserted into a gap between the back electrode roller 22 and the aperture electrode 1. Further, the back electrode roller 22 is connected to the DC power source 24. The DC power source 24 serves to apply a voltage of +1 kV to the back electrode roller 22.

The supporter feeding portion 40 comprises the back electrode roller 22 and a fixing device 26. The supporter P is fed to the fixing device 26 through the disposing position of the back electrode roller 22, which is an image forming position. The fixing device 26 includes a heat roller 26A having a heat source (not shown) therein, and a press roller 26B, which is pressed against the heat roller 26A. The supporter P having an image formed thereon is sandwiched between the two rollers 26A and 26B in the fixing device 27 to heat-fix the toner image on the supporter P and then discharged through a discharge port (not shown) to the outside of the image forming apparatus.

Next, the operation of the image forming apparatus thus constructed is described with reference to FIGS. 1 and 2.

Upon input of a command for image formation into the image forming apparatus, the toner carry roller 14 and the toner supply roller 12 first start their rotation in the directions as indicated by the arrows shown in FIG. 1. Through this rotational motion, the toner 16 carried on the surface of the toner supply roller 12 is rubbed against (frictionally contacted with) the surface of the toner carry roller 14 to be further negatively charged and carried on the surface of the toner carry roller 14. The toner 16 carried on the toner carry roller 14 is thinned and substantially uniformly charged by the toner-layer restricting blade 18 and then fed toward the aperture electrode unit 1 by the rotation of the toner carry roller 14. Finally, the toner 16 on the toner carry roller 14 is supplied to the lower side of the apertures 6 while being rubbed against the insulating sheet 2 of the aperture electrode unit 1.

Here, in accordance with the input image signal, a voltage of +50V is applied from the control voltage applying circuit 8 to those control electrodes 4 which correspond to an image portion. So, an electric line of force directing from the control electrodes 4 to the toner carry roller 14 occurs due to the potential difference between the control electrodes 4 and the toner carry roller 14. With this electric line of force, the negatively charged toner 16 is electrostatically attracted to a higher potential position, so that the toner 16 is electrostatically attracted from the surface of the toner carry roller 14 through the apertures 6 to the side of the control electrodes 4. The attracted toner 16 at the control electrodes side is further electrostatically attracted and flies toward the supporter P due to electric field that is caused between the supporter P and the aperture electrode unit 1 by +1 kV voltage applied to the back electrode roller 22 and deposited on the supporter P, whereby an image is formed on the supporter P.

On the other hand, a voltage of 0V is applied from the control voltage applying circuit 8 to those control electrodes 4 that correspond to a non-image portion. As a result, no electric line of force is formed in the neighborhood of the apertures 6 corresponding to the non-image portion between the control electrodes 4 and the toner carry roller 14. Accordingly, no electrostatic attraction force is applied to the negatively charged toner. Thus, no toner 16 on the toner carry roller 14 passes through the apertures 6.

In this case, since the insulating sheet 2 is formed of a material having higher dielectric constant than the toner 16, the voltage applied from the control voltage applying circuit 8 is sufficiently shared with the toner layer side. Thus, a control electric field that effectively directly drives the toner 16 can be formed. That is, the intensity of the electric field (voltage) applied to the toner layer is shared by the capacity of the dielectric substance disposed between the toner carry roller 14 and the control electrodes 4. In this case, the toner layer and the insulating sheet 2 serves as this dielectric substance. A lower partial voltage is shared with a larger capacity portion of the dielectric substance. The capacity of the dielectric substance is directly proportional to its dielectric constant and area and inversely proportional to its thickness. Further, by setting the dielectric constant of the insulating sheet 2 to be higher than that of the toner layer like this embodiment, the partial voltage that is shared with the toner layer becomes higher than the partial voltage shared with the insulating sheet 2. So, the control performance of the toner 16 can be improved.

Further, according to this embodiment, by increasing the dielectric constant of the insulating sheet, the capacity thereof is not significantly increased even when the thickness is relatively increased. So, the electric-field control performance can be improved even with a rigid electrode structure. In the prior art, only a means of designing the insulating sheet of the electrode to be thin has been adopted to perform low-voltage driving for the purpose of low cost. Thus, an electrode having extremely low rigidity must be used, so the printing operation is unstable. However, in this embodiment, the recording operation can be performed not only with a low voltage, but also with a stable printing performance.

The supporter P is fed by a distance corresponding to one picture element by the supporter feeding portion 40 in a direction perpendicular to the array of the apertures 6 during a process of forming a row of picture elements on the surface of the supporter P with the toner 16. This process is repeated to form a toner image representing a desired image on the whole surface of the supporter P. Thereafter, the formed toner image is fixed onto the supporter P by the fixing device 26. Finally, the supporter P having the toner image thereon is discharged through the discharge port (not shown) to the outside of the image forming apparatus.

If insulating toner is used in the image forming apparatus as described above, insulation can be kept between the toner carry roller 14 and the control electrodes 4, and no breakdown would occur in the apertures 6.

Further, in the above process, the control electrodes 4 form the control electric field inside of the control electrodes 4 and the apertures 6 and between the apertures 6 and the toner carry surface of the toner carry roller 14 that faces the apertures 6. Accordingly, the control electric field can be directly applied to the toner 16 carried on the toner carry surface, and thus control efficiency is high.

Still further, since the toner carry roller 14 and the aperture electrode unit 1 are disposed to confront each other through the toner layer, they can be disposed relatively near to each other. So, the control voltage can be reduced, and inexpensive driving elements can be used.

The insulating sheet 2 of the aperture electrode unit 1 is disposed to face the toner carry roller 14. So, even when no toner 16 exists on the toner carry roller 14 due to failure of the toner supply system, there occurs no electrical short-circuit due to contact between the control electrodes 4 and the toner carry roller 14, and no breakdown occurs in the driving elements.

Further, the aperture electrode unit 1 and the toner 16 on the toner carry roller 14 contact each other at the entrance portions of the apertures 6. Thus, the toner 16 deposited at the entrance portions of the apertures 6 is pushed out by toner that is continuously supplied by the toner carry roller 14. So, the apertures 6 are prevented from being clogged with the toner 16 due to deposition and bridging of the toner 16 over the apertures 6.

As is apparent from the foregoing, according to the image forming apparatus of this invention, at least a part of the electric-field control means is formed of a high-dielectric substance having a dielectric constant higher than the charged particles (toner). Thus, the intensity of electric field of the toner layer can be increased even when the high-dielectric substance portion is made thick. Therefore, the electrode can be designed with excellent electric-field control performance and high mechanical strength, the image quality is improved, and high recording operation can be performed.

This invention is not limited to the above embodiment, and various modifications may be made to the embodiment without departing from the subject matter of this invention.

Figure 4:
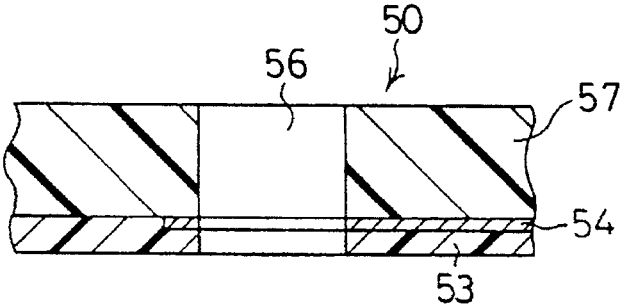
FIG. 4 is a cross-sectional partial side view showing the construction of an aperture electrode unit of another embodiment.

For example, an aperture electrode unit 50 as shown in FIG. 4 may be used. This aperture electrode unit 50 includes an insulating slide film 53, control electrodes 54, a support member 57 and apertures 56.

The support member 57 is formed of a thin plate of a resin film, ceramics or the like, and has a degree of mechanical rigidity. The thickness of the support member 57 is substantially in the range of about 50 μm to 100 μm.

On the lower surface of the support member 57 are provided plural control electrodes 54, which are insulated from one another. The control electrodes 54 have the same construction as the control electrodes 4 as described above.

The insulating slide film 53 of about 10 μm thickness or less is further provided on the lower surface of the support member 57 to cover the control electrodes 54. The insulating slide film 53 is formed of the same material as the insulating sheet 2 as described above and has a dielectric constant higher than that of the toner. Accordingly, the insulating slide film 53 has the same function as the insulating sheet 2. It is disposed to substantially contact the toner carry roller 14 when it is installed in the image forming apparatus.

The apertures 56 are provided to penetrate through the support member 57, the control electrodes 54 and the insulating slide film 53.

By designing the aperture electrode unit 50 in a double-layer structure as described above, the whole structure of the aperture electrode unit has excellent rigidity because of the provision of the support member 57 even when the insulating slide film 53 is made thin. Further, since the insulating slide film 53 having a dielectric constant higher than that of the toner can be designed to be thin, the voltage-division (sharing) can be further effectively performed, and more excellent recording characteristics are expectably obtained. In addition, the apertures 56 are also thick. Thus, there is little possibility that the toner 16 will jump out through the apertures 56 by only a mechanical force.

In the above embodiments, each of the insulating sheet 2 and the insulating slide film 53 is designed in a monolayer structure. However, the structure of the insulating sheet and film is not limited to the monolayer structure, and the structure may be a multilayer structure with a portion having high dielectric constant.

Figure 5:
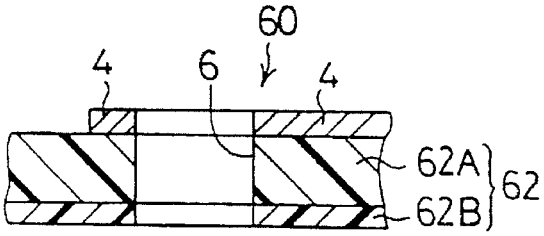
FIG. 5 is a cross-sectional partial side view showing the construction of an aperture electrode unit of another embodiment.

For example, as shown in FIG. 5, an aperture electrode unit 60 comprises an insulating sheet 62, control electrodes 4 and apertures 6. The insulating sheet 62 is designed in a double-layer structure, and comprises a low dielectric sheet 62A serving as a low dielectric constant portion and a high dielectric sheet 62B serving as a high dielectric constant portion. The high dielectric sheet 62B has a dielectric constant higher than that of the toner 16.

In this case, the high dielectric sheet 62B is provided on the lowermost surface. However, the low dielectric sheet 62A may be provided on the lowermost surface. Alternatively, the insulating sheet 62 may be designed in a three-layer structure in which the high dielectric sheet 62B is sandwiched by the low dielectric sheets 62A. That is, it is sufficient that the high dielectric sheet 62B is disposed nearer to the toner carry roller side than the control electrodes 4.

Figure 6:
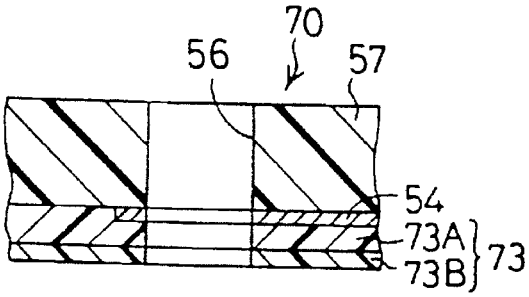
FIG. 6 is a cross-sectional partial side view showing the construction of an aperture electrode unit of another embodiment.

As another modification, an aperture electrode unit 70 may comprise an insulating slide film 73, control electrodes 54, apertures 56 and a support member 57, as shown in FIG. 6. The insulating slide film 73 is designed in a double-layer structure and comprises a low dielectric slide film 73A serving as a low dielectric constant portion and a high dielectric slide film 73B serving as a high dielectric constant portion. The high dielectric slide film 73B has a dielectric constant higher than the toner.

In this case, the high dielectric slide film 73B is provided on the lowermost surface. However, the low dielectric slide film 73A may be provided on the lowermost surface. Alternatively, the insulating slide film 73 may be designed in a three-layer structure in which the high dielectric slide film 73B is sandwiched by the low dielectric slide films 73A. That is, it is sufficient that the high dielectric slide film 73B is disposed nearer to the toner carry roller side than the control electrodes 4.

In the above embodiment, the voltage of 0V is applied from the control voltage applying circuit to the control electrodes corresponding to the non-image portion. However, a negative voltage may be applied to these control electrodes. In this case, an electric line of force, which directs in a opposite direction to that when 50V is applied to the control electrodes, occurs in the neighborhood of the apertures between the control electrodes and the toner carry roller. Consequently, the negatively charged toner is attracted to a higher potential direction, that is, to the toner carry roller side, so that no toner can pass through the apertures. Further, even when a part of the supplied toner suffers a mechanical force due to a sliding contact with the aperture electrode unit and invades into the apertures corresponding to the non-image portion, the toner can be controlled not to pass through the apertures by electric field in the apertures. Therefore, the control performance for the toner is excellent, and an image can be obtained with higher image quality.

Further, in the above embodiment, the aperture electrode unit is used as toner flow control means. However, a mesh-type electrode unit as disclosed in U.S. Pat. No. 5,036,341 may be used.

What is claimed is:

1. An image forming apparatus for forming an image on a support comprising:

a toner supply means for supplying charged toner particles to the support for forming the image thereon, the charged toner particles having a first dielectric constant; and a toner flow control means for controlling a flow of charged toner particles from the toner supply means to the support, the toner flow control means disposed adjacent to and in contact with the toner supply means, wherein the toner flow control means comprises an aperture electrode unit including an insulating member with apertures therein and control electrodes surrounding each aperture that are adapted to be electrically coupled to a voltage source, and wherein the insulating member confronts the toner supply means and has at least a portion with a second dielectric constant that is higher than the first dielectric constant of the charged toner particles.

2. The image forming apparatus of claim 1 wherein the insulating member is formed of a material selected from the group consisting of synthetic resins and oxides.

3. The image forming apparatus of claim 2 wherein the insulating member is formed of a material selected from the group consisting of phenolic resin, polyethylene terephthalate, polyester resin, alkyd resin, epoxy resin, phenoxy resin, polycarbonate resin, silicone resin, urea resin, melamine resin, nylon, polyimide, polymethyl methacrylate, methyl methacrylate-styrene copolymerization, acrylonitride-butadiene-styrene copolymerization, polyvinyl chloride, polyvinylidene chloride, polyvinylidene fluoride, polyvinyl formal, polyvinyl butyral, polyvinyl carbazole, acetal resin, chlorinated polyether, polysuflone, acetylcellulose, nitrocellulose, celluloid, alumina, beryllia, calcia, magnesia, silicon oxide, thoria, urania, mullite, spinel, forsterite, zirconia, and zircon.

4. The image forming apparatus of claim 1 wherein the insulating member is formed of a material selected from the group consisting of oxide ferroelectric substances and organic ferroelectric substances.

5. The image forming apparatus of claim 4 wherein the insulating member is formed of a material selected from the group consisting of barium titanate, lead titanate, lead niobate, potassium niobate, potassium tantalate, polyvinylidene fluoride, vinylidene fluoride-ethylene trifluoride copolymerization, and vinylidene cyanide-vinyl acetate copolymerization.

6. The image forming apparatus of claim 1 wherein the insulating member is a slide film disposed on a support, and the control electrodes are disposed between the support and the slide film.

7. The image forming apparatus of claim 1 wherein the insulating member comprises a plurality of layers.

8. The image forming apparatus of claim 7 wherein the insulating member comprises at least two layers including a first layer having the second dielectric constant and a second layer having a dielectric constant that is lower than the second dielectric constant.

9. The image forming apparatus of claim 8 wherein the insulating member comprises three layers including a third layer having a low dielectric constant, wherein the first layer having the second high dielectric constant is sandwiched between the second and third layers having the low dielectric constant.

10. An image forming apparatus comprising:

a toner carrier that carries and supplies charged toner particles having a dielectric constant to an image supporter for forming an image thereon; and an electric-field controller having apertures therein and disposed to face and contact the toner carrier that controls a flow of the charged toner particles through the apertures from the toner carrier to the image supporter with an electric field, wherein at least a part of the electric-field controller in which the apertures are formed is made of a high dielectric substance having a dielectric constant higher than the dielectric constant of the charged toner particles.

11. The image forming apparatus of claim 10, wherein the electric-field controller comprises an insulating member having a first surface that confronts the toner carrier and a second surface that is opposed to the toner carrier, and a plurality of control electrodes electrically insulated from each other provided on the second surface of the insulating member opposed to the toner carrier, wherein apertures are formed in correspondence with each of the control electrodes so as to penetrate through the insulating member and the control electrodes.

12. The image forming apparatus of claim 11, wherein at least a part of the insulating member is formed of the high dielectric substance.

13. The image forming apparatus of claim 11, wherein at least the first surface of the insulating member is formed of the high dielectric substance.

14. The image forming apparatus of claim 11, wherein said insulating member comprises a material selected from the group consisting of phenolic resin, polyethylene terephthalate, polyester resin, alkyd resin, epoxy resin, phenoxy resin, polycarbonate resin, silicone resin, urea resin, melamine resin, nylon, polyimide, polymethyl methacrylate, methyl methacrylate-styrene copolymerization, acrylonitride-butadiene-styrene copolymerization, polyvinyl chloride, polyvinylidene chloride, polyvinylidene fluoride, polyvinyl formal, polyvinyl butyral, polyvinyl carbazole, acetal resin, chlorinated polyether, polysuflone, acetylcellulose, nitrocellulose, celluloid, alumina, beryllia, calcia, magnesia, silicon oxide, thoria, urania, mullite, spinel, forsterite, zirconia, zircon, barium titanate, lead titanate, lead niobate, potassium niobate, potassium tantalate, polyvinylidene fluoride, vinylidene fluoride-ethylene trifluoride copolymerization, and vinylidene cyanide-vinyl acetate copolymerization.

15. The image forming apparatus of claim 10 wherein the electric-field controller comprises a support member having two surfaces, a plurality of control electrodes provided on one surface of said support member electrically insulated from one another, and an insulating slide film provided on the other surface of said support member covering the control electrodes and confronting the toner carrier, wherein a plurality of apertures are provided in correspondence with each of the control electrodes so as to penetrate through the support member, the control electrodes and the insulating slide film.

16. The image forming apparatus of claim 15, wherein at least a part of the insulating slide film is formed of the high dielectric substance.

17. The image forming apparatus of claim 15, wherein at least a surface of the insulating slide film facing the toner carrier is formed of the high dielectric substance.

* * * * *